US009735503B2

(12) United States Patent
Tohjo

(10) Patent No.: US 9,735,503 B2
(45) Date of Patent: Aug. 15, 2017

(54) CONNECTOR FOR RECEIVING AND ELECTRICALLY CONNECTING WITH A CABLE

(71) Applicant: PANASONIC CORPORATION, Osaka (JP)

(72) Inventor: Katsutoshi Tohjo, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/011,450

(22) Filed: Aug. 27, 2013

(65) Prior Publication Data

US 2014/0057475 A1 Feb. 27, 2014

(30) Foreign Application Priority Data

Aug. 27, 2012 (JP) ..... 2012-186113

(51) Int. Cl.
*H01R 12/88* (2011.01)
*H01R 13/629* (2006.01)

(52) U.S. Cl.
CPC ..... *H01R 13/62938* (2013.01); *H01R 12/88* (2013.01)

(58) Field of Classification Search
USPC ..... 439/329, 62, 81, 260, 267, 495
See application file for complete search history.

(56) References Cited

U.S. PATENT DOCUMENTS 5,785,549 A * 7/1998 Takayasu ..... H01R 12/88 439/495
7,172,446 B1 * 2/2007 Hashimoto et al. ..... 439/260
7,311,542 B2 * 12/2007 Suzuki ..... 439/260
7,931,492 B1 * 4/2011 Chen ..... 439/495
2008/0233781 A1 * 9/2008 Matoba et al. ..... 439/258
(Continued)

FOREIGN PATENT DOCUMENTS

CN 202076456 U 12/2011
JP 2008-282668 A 11/2008
JP 2011034684 A * 2/2011
(Continued)

OTHER PUBLICATIONS

Chinese Search Report dated May 18, 2016 issued in Chinese Patent Application No. 201310376229.0 (English translation).

*Primary Examiner* — Renee Luebke
*Assistant Examiner* — Paul Baillargeon
(74) *Attorney, Agent, or Firm* — McDermott Will & Emery LLP

(57) ABSTRACT

A connector includes: a housing 3 accommodating at least one of a conductive contact 5; an insertion opening 4 to which a flat cable 2 can be inserted, the insertion opening 4 being provided in front part of the housing 3 and being defined by upper and lower walls 33 and 32 of the housing 3 at the top and bottom; and a lever 6 which is provided in the back part of the housing 3 and is turned to bring the contacts 5 into pressure contact with the flat cable 2 and establish electrical continuity therebetween. The contact 5 includes a first contact 5A which is engaged with the housing 3 at such a position that press-fit forces produced in the direction orthogonal to the press-fit direction when the contact 5A is press-fitted into the housing 3 are not in the same straight line.

9 Claims, 9 Drawing Sheets

(56) References Cited

U.S. PATENT DOCUMENTS

| | | | | |
|---|---|---|---|---|
| 2010/0184317 | A1* | 7/2010 | Sunaga | H01R 12/57<br>439/260 |
| 2011/0312202 | A1* | 12/2011 | Matoba et al. | 439/329 |

FOREIGN PATENT DOCUMENTS

| | | | |
|---|---|---|---|
| WO | WO 2008033319 | A1 * | 3/2008 |
| WO | WO 2011094701 | A2 * | 8/2011 |

* cited by examiner

CONNECTOR FOR RECEIVING AND ELECTRICALLY CONNECTING WITH A CABLE

CROSS REFERENCE TO RELATED APPLICATIONS

This application is based upon and claims the benefit of priority from prior Japanese Patent Application P2012-186113 filed on Aug. 27, 2012; the entire contents of which are incorporated by reference herein.

BACKGROUND OF THE INVENTION

The present invention relates to a connector.

Conventionally-known connectors include front-lock connectors having a lever in the front part of the housing (in the insertion opening side) and back-lock connectors having a lever in the back part of the housing.

The housing accommodates electrically-conductive contacts. Each contact includes a pair of arms which are positioned on the upper and lower sides of a flat cable. The flat cable is inserted between the pair of arms. When the lever is operated in this state, the pair of arms sandwich the upper and lower surfaces of the flat cable with the front ends thereof about a fulcrum, provided between the both arms, as a center.

In this process, the rotation force of the lever acts on the front end side of each arm with respect to the fulcrum in a front-lock connector. On the other hand, in a back-lock connector, the rotation force of the lever acts on the back end side of each arm with respect to the fulcrum. In other words, the front-lock connector is configured to hold the flat cable by causing the rotation force of the lever to directly act in such a direction as to close the front end of the connector. On the other hand, the back-lock connector holds the flat cable at the front end, which is closed by causing the rotation force of the lever to act in such a direction as to open parts of the arms backward of the fulcrum of the connector. The front-lock and back-lock connectors, therefore, differ from each other in position where the rotation force of the lever acts on the contacts, such as forward of or backward of the fulcrum. However, the back-lock connectors can include space to accommodate the laid-down lever in the backward of the contacts and can have a lower profile than the front-lock connectors have.

Herein, the structure to press-fit a contact into the housing and hold the same is described in Japanese Patent Laid-open Publication No. 2008-282668. Specifically, the connector includes a body portion extending in the press-fit direction and protrusion portions protruding from the body portion in a direction orthogonal to the press-fit direction. The housing includes: a contact hole into which the contact is press-fitted; and protrusion holding portions which communicate with the contact hole and hold the protrusions of the contact. The contact is press-fitted into the contact hole of the housing until the protrusions of the contact reach the respective protrusion holding portions of the housing to be held.

SUMMARY OF THE INVENTION

However, when the contact is press-fitted into the housing, the housing is subjected to a large load because of the press-fit force. Accordingly, the press-fitted contacts create some bulges in the back surface of the housing in some cases. Such a problem is more pronounced in thinner connectors.

An object of the present invention is to provide a connector in which a load on the housing due to press-fitting of contacts can be reduced.

A first aspect of the present invention relates to a connector, including: a housing accommodating at least one of a conductive contact; an insertion opening into which a flat cable can be inserted, the insertion opening being provided in the front part of the housing and being defined by upper and lower walls of the housing at the top and bottom; and a lever which is provided in the back part of the housing and is turned to bring the contacts into pressure contact with the flat cable and establish electrical continuity therebetween. In the connector, the contact includes a first contact which is engaged with the housing at such a position that press-fit forces produced in the direction orthogonal to the press-fit direction when the contact is press-fitted into the housing are not in a same line.

In the first aspect, the orthogonal direction may be a direction that the first contact comes into pressure contact with the flat cable.

Moreover, in the first aspect, the first contact may include a protrusion protruding in the orthogonal direction while the housing includes an engagement portion engaged with the protrusion. The protrusion may be engaged with the engagement portion at a position shifted in the press-fit direction from the center of an upper surface of the engagement portion in the press-fit direction.

A second aspect of the present invention is a connector including: a housing accommodating at least one of a conductive contact; an insertion opening to which a flat cable can be inserted, the insertion opening being provided in front part of the housing and being defined by upper and lower walls of the housing at the top and bottom; and a lever which is provided in the back part of the housing and is turned to bring the contacts into pressure contact with the flat cable and establish electrical continuity therebetween. The contact includes a first contact provided with a contact-side engagement portion which is engaged with a housing-side engagement portion provided in the housing when the first contact is inserted into the housing. When the contact-side engagement portion is engaged with the housing-side engagement portion, movement of the first contact relative to the housing toward a removal side in an insertion/removal direction is limited.

In the second aspect, movement of the first contact relative to the housing toward the removal side in the insertion/removal direction may be limited by bringing a face of the contact-side engagement portion on the removal side in the insertion/removal direction into contact with a face of the housing-side engagement portion on the insertion side in the insertion/removal direction.

Moreover, in the second aspect, the first contact may be composed of a moving arm driven by a cam portion provided for the lever and a fixed arm fixed to the housing, the moving and fixed arms being joined with a joint spring portion to form a substantially H shape, and the contact-side engagement portion may be provided in a portion of the fixed arm on the insertion side in the insertion/removal direction with respect to the joint spring portion.

Furthermore, in the second aspect, the fixed arm may be located below the moving arm while the contact-side engagement portion is provided in lower part of the fixed arm, and the housing-side engagement portion may be provided in upper part of the lower wall of the housing.

Still furthermore, in the second aspect, the housing-side engagement portion may be provided on the insertion side in the insertion/removal direction with respect to the center in the insertion/removal direction, of the lower wall of the housing.

Still furthermore, in the second aspect, the housing may include an upper regulation portion which limits upward movement of the insertion side of the fixed arm in the insertion/removal direction.

DETAILED DESCRIPTION OF THE PREFERRED EMBODIMENTS

Hereinafter, a description is given of an embodiment of the present invention in detail with reference to the drawings.

FIGS. 1 to 11 (except FIGS. 7 to 9) are views illustrating an embodiment of a connector 1 according to the present invention. The connector 1 connects a flat cable 2, such as an FPC (flexible printed circuit board) or an FFC (flexible flat cable), to a circuit substrate C (see FIG. 4) to establish electrical continuity therebetween.

Figure 1:
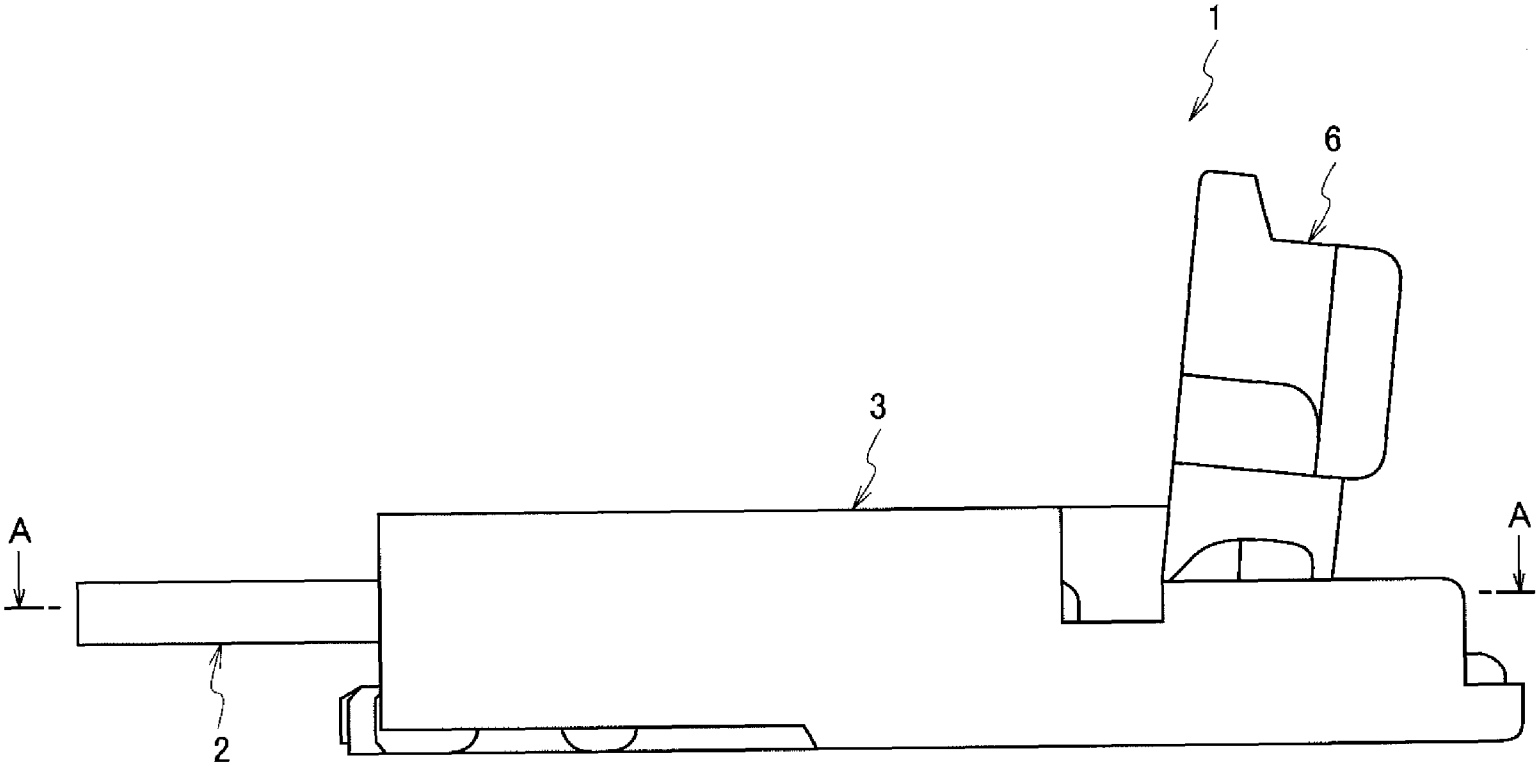
FIG. 1 is a side view of a connector according to an embodiment of the present invention.
Figure 2:
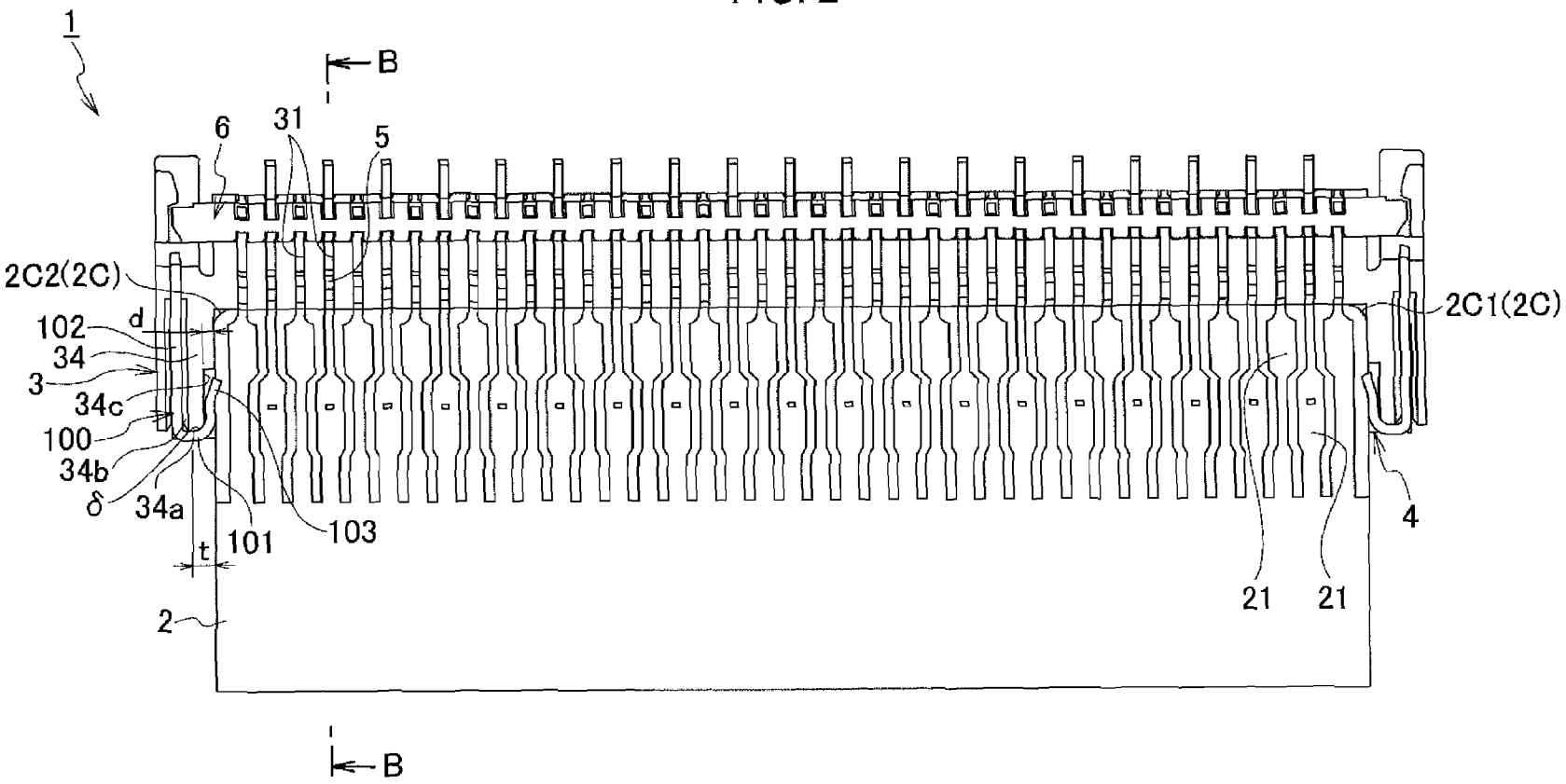
FIG. 2 is a cross-sectional view taken along a line A-A of FIG. 1.

As illustrated in FIGS. 1 and 2, the connector 1 includes an insulating housing 3. In the front part (the lower part in FIG. 2) of the housing 3, an insertion opening 4, into which the flat cable 2 can be inserted, is provided. The housing 3 accommodates plural conductive contacts 5 that can be freely connected to the flat cable 2 inserted into the insertion opening 4 to establish electrical continuity therebetween. The contacts 5 are arranged side by side in an orderly fashion.

To the back part (upper part of FIG. 2) of the housing 3, a lever 6 is attached. The lever 6 is turned to bring the contacts 5 into press contact with the flat cable 2 so that the contacts 5 and flat cable 2 are connected to establish electrical continuity therebetween.

The housing 3 is made of an insulating material such as synthetic resin. The housing 3 includes plural slots 31 to which the contacts 5 are attached. The slots 31 penetrate in the front-back direction of the housing 3 (in the vertical direction of FIG. 2) and are arranged in the cross direction (in the width direction: in the horizontal direction of FIG. 2). The width of each slot 31 is defined by partition walls 35. Each partition wall 35 includes a cutout portion 35*a* which is opened toward the front side and allows the flat cable 2 to be inserted therein. The plural contacts 5 are attached to the respective slots 31 and are thereby arranged side by side in an orderly fashion.

Figure 3:
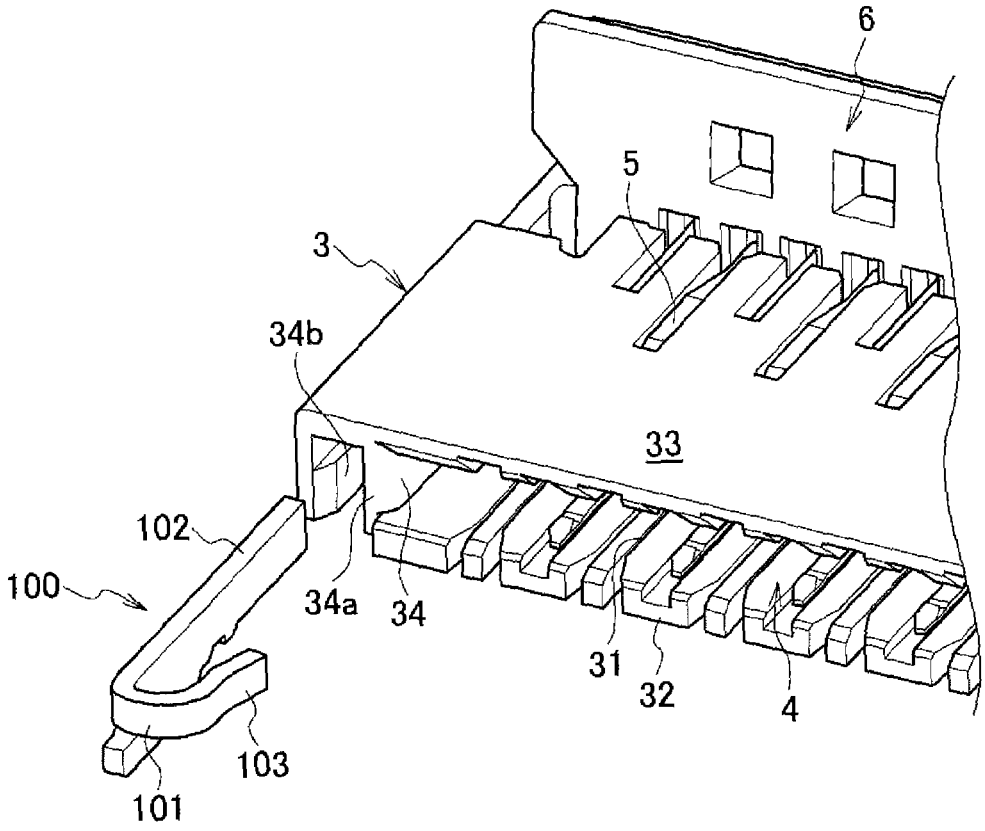
FIG. 3 is a perspective view illustrating attachment of a protection member illustrated in FIG. 2.

As illustrated in FIG. 3, the insertion opening 4 is defined by a lower wall 32, an upper wall 33, and side walls 34 as a flat rectangular shape extending in the cross-direction. More specifically, the insertion opening 4 is defined by the upper and lower walls 33 and 32 of the housing 3 at the top and bottom and is defined by the side walls 34 at both ends in the width direction. As a matter of course, the opening area of the insertion opening 4 has vertical and horizontal dimensions corresponding to the thickness and width of the flat cable 2. The housing 3 only needs to define the top and bottom of the insertion opening 4 with the upper and lower walls 33 and 32, and the both ends of the insertion opening 4 may be defined by side walls made of a material different from the housing 3 (for example, metallic plates, resin plates, or the like).

Figure 4:
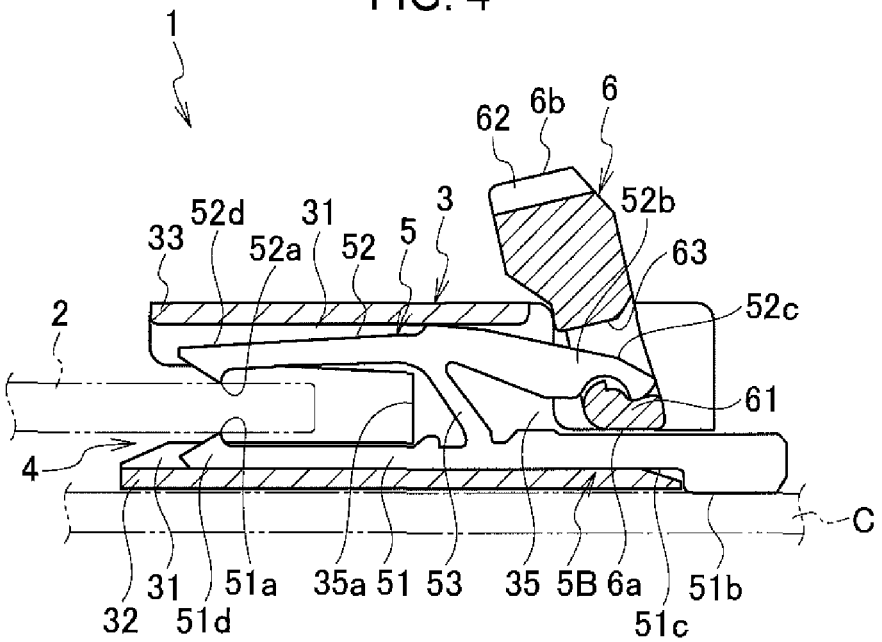
FIG. 4 is a cross-sectional view illustrating an unlocked position of a lever taken along a line B-B of FIG. 2.

As illustrated in FIG. 4, the contacts 5 are formed by using a press for punching of a conductive material sheet having a predetermined thickness, for example. Each of the thus-formed contacts 5 includes a bar-shaped fixed arm 51 and a bar-shaped moving arm (a moving arm driven by a cam portion 61 provided for the lever 6) 52. The fixed arm 51 extends in the front-back direction (in the vertical direction in FIG. 2). The moving arm 52 extends in the same direction as the fixed arm 51 extends and faces the fixed arm 51 in the thickness direction of the flat cable 2. In this embodiment, each of the contacts 5 is accommodated in the housing 3 so that the fixed arm 51 is located under the moving arm 52. The fixed and moving arms 51 and 52 have longitudinally intermediate portions joined with a joint spring portion 53 to form a substantially H shape as a whole. The joint spring portion 53 serves as a fulcrum when the moving arm 52 opens or closes. At the back end of the fixed arm 51 is provided a terminal portion 51*b*, which is mounted on the circuit substrate C. Through the terminal portion 51*b*, electrical continuity between the contacts 5 and the circuit substrate C is established. Furthermore, the back end of the moving arm 52 includes a spring portion 52*b*. When the contacts 5 are press-fitted into the housing 3, the contacts 5 are engaged with the housing 3. This structure for engaging the contacts 5 is described in detail later.

In this embodiment, signal terminals 21 of the flat cable 2 are arranged in a zigzag manner. The contacts 5 including two types of contacts 5A and 5B that have different effective fitting length (arm length between the joint spring portion and the moving arm contact portion) are alternately arranged side by side so as to fit to the zigzagged signal terminals 21. Specifically, the effective fitting length of the contacts 5B, which are arranged at the even-numbered positions from one end in the width direction of the housing 3, is longer than that of the contacts 5A, which are arranged at the odd-numbered positions from the one end. This structure is practical because generally, contacts at even-numbered positions have long effective fitting length, while contacts at odd-numbered positions have short effective fitting length.

In this embodiment, the contacts 5A and 5B are alternately arranged side by side so that the contacts at the both ends in the width direction of the housing 3 are the contacts 5A, which have short effective fitting length. Accordingly, the contacts 5A are located at odd-numbered positions from either end in the width direction of the housing 3, and the contacts 5B are located at even-numbered positions from either end in the width direction of the housing 3. In this embodiment, as described above, the contacts 5 include the contacts (first contacts: contacts having short effective fitting length) 5A and the contacts (second contacts: contacts having long effective fitting length) 5B. The number of types of the contacts 5 is not limited to two and may be one, three, or more.

The contacts 5A are inserted (press-fitted) into the respective slots 31 from the front side (one side in the press-fit direction), and the contacts 5B are inserted (pressed-fitted) into the respective slots 31 from the back side (the other side in the press-fit direction). In other words, in this embodiment, the contacts 5A and 5B are inserted into the respective slots 31 in the different directions to be press-fitted into the housing 3.

The lever 6 is integrally molded by injection molding of an insulating material such as synthetic resin. The lever 6 includes a cam portion 61 at an end 6*a* (at the lower end in FIG. 4). The cam portion 61 produces pressing force at the fixing arm contact portion 51*a* and moving arm contact portion 52*a* of each contact 5 in the closing direction. At another end 6*b* (at the upper end in FIG. 4) is provided an operating portion 62, with which the lever 6 is turned.

The lever 6 is located at the back end side of the contacts 5, including the terminal portions 51*b* and spring portions 52*b*, and the cam portion 61 is located between the back ends 51*c* of the fixed arms 51 and the back ends 52*c* of the moving arms 52. The lever 6 includes openings 63 into which the back ends 52*c* of the moving arms 52 are inserted. In such a manner, the lever 6 is provided at the back ends of the contacts 5, that is, at the back end of the housing 3, thus constituting the back-lock connector 1.

Figure 5:
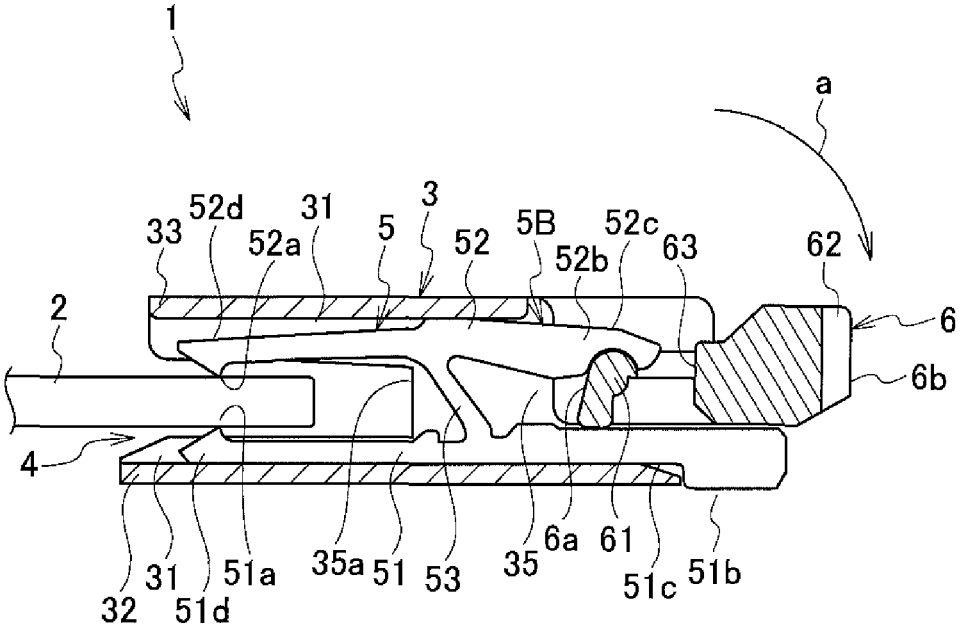
FIG. 5 is a cross-sectional view illustrating a locked position of the lever, FIG. 5 corresponding to FIG. 4.

The lever 6 is raised in an unlocked position at the initial state illustrated in FIG. 4. On the other hand, when the lever 6 is turned backward as indicated by an arrow a to be laid down with the flat cable 2 being inserted in the insertion opening 4, as illustrated in FIG. 5, the lever 6 is brought into the locked position. In this locked position, the flat cable and contacts 5 established electrical continuity. Specifically, when the operation portion 62 of the lever 6 is turned backward to be laid down, the cam portion 61 works to push apart the back ends 51*c* and 52*c* of the fixed and moving arms 51 and 52 of each contact 5. The fixed arm 51 and moving arm 52 then move so that the front ends 51*d* and 52*d* are closed about the joint spring portion 53 as the fulcrum. Therefore, the fixed and moving arm contact portions 51*a* and 52*a*, which are provided for the front ends 51*d* and 52*d* of the fixed and moving arms 51 and 52, respectively, can strongly sandwich the both surfaces of the flat cable 2. This can prevent the flat cable 2 from falling off while establishing electrical continuity between the contacts 5 and flat cable 2.

As described above, in the back-lock connector 1, the lever 6 can be provided in the backward of the contacts 5 so as not to overlap the contacts 5 when the lever 6 is in the locked position. This can facilitate reducing the height of the connector 1 of this embodiment compared to front-lock connectors.

Figure 6:
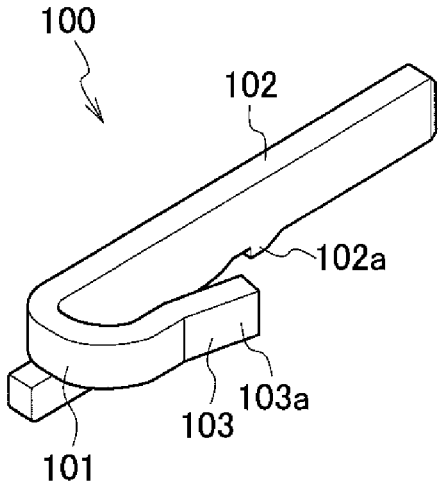
FIG. 6 is an enlarged perspective view of a protection member illustrated in FIG. 3.

As illustrated in FIGS. 2 and 3, in the insertion opening 4, into which the flat cable 2 is inserted, protection members 100 protecting the side walls 34 of the insertion opening 4 are provided. As illustrated in FIG. 6, each protection member 100 includes a straight attachment portion 102. An end of the straight attachment portion 102 is bent in a U-shape, and the portion bent in the U shape constitutes a guard portion 101 protecting a front surface 34*a* of the corresponding side wall 34. The guard portion 101 is integrally formed by processing a part (the end portion) of the attachment portion 102. Preferably, the protection members 100 are entirely made of a metallic material excellent in abrasion resistance, such as phosphor bronze, brass, titanium copper, beryllium copper, and stainless, for example.

On the other hand, as illustrated in FIG. 2, an attachment hole 34*b* is formed in each side wall 34 with a predetermined thickness t left inside so as to extend in the same direction as the side wall 34 extends. In the attachment hole 34*b*, the attachment portion 102 of the protection member 100 is inserted. When the attachment portion 102 is inserted into the attachment hole 34*b*, the U-shaped guard portion 101 of the protection member 100 covers the front surface (front end) 34*a* of the side wall 34.

In the middle of the lower side of the attachment portion 102, an engagement protrusion 102*a* is provided. The engagement protrusion 102*a* is configured to be engaged with an engagement recess (not shown) provided for the attachment hole 34*b*. The engagement protrusion 102*a* is engaged with the engagement recess to be prevented from falling off.

Each of the protection members 100 includes a cable holding portion 103 extending from the end of the guard portion 101 towards the inside of the insertion opening 4. The cable holding portion 103 is configured to apply a certain pressure-energization force to both sides of the flat cable 2. In such a manner, the protection member 100 includes the guard portion 101, attachment portion 102, and cable holding portion 103, thus forming a hook shape as a whole.

While each protection member 100 is provided with the cable holding portion 103, a slot 34*c* with a depth d is provided in the inside of each side wall 34 of the insertion opening 4 as a space to accommodate the cable holding portion 103. Preferably, the depth d of the slot 34*c* is equal to or slightly larger than the thickness of the cable holding portion 103.

The cable holding portion 103 of this embodiment is extended from the end of the guard portion 101 toward the inside of the insertion opening 4 along the side wall 34, and a front end portion 103*a* thus extended is slightly bent toward the center of the insertion opening 4 in the width direction. Accordingly, the front end portion 103*a* of the cable holding portion 103 protrudes a little beyond the inner side of the side wall 34 into the insertion opening 4 in a natural state. Because of the resilient force of the guard portion 101 bent in the U shape, the cable holding portions 103 have energization force that pushes the corresponding side surface of the inserted flat cable 2.

FIG. 2 illustrates the natural state of the cable holding portion 103, and the front end portion 103*a* of the cable holding portion 103 protrudes inward beyond the corresponding side surface of the flat cable 2. However, in an actual state where the flat cable 2 is inserted into the insertion opening 4, the front end portion 103*a* of the cable holding portion 103 is pushed by the corresponding side surface of the flat cable 2 toward the outside of the side surface.

As illustrated in FIG. 2, moreover, when the protection members 100 are attached to the respective side walls 34, a predetermined gap 5 is provided between the guard portion 101 of each protection member 100 and the front surface 34*a* of the corresponding side wall 34.

The surface of each protection member 100 of this embodiment is plated. The protection members 100 are attached to the respective side walls 34 of the insertion opening 4. The paired protection members 100 are placed symmetrically.

In the connector 1 of this embodiment, the terminal portions 51*b* of the contacts 5 are mounted on the circuit board C as described above. On the other hand, when the lever 6 is brought into the locked position after the flat cable 2 is inserted into the insertion opening 4 of the connector 1, the flat cable 2 and contacts 5 establish electrical continuity therebetween. Accordingly, by bringing the lever 6 into the locked position with the flat cable 2 being inserted into the insertion opening 4, the flat cable 2 and circuit substrate C establish electrical continuity through the contacts 5.

Next, the contact engagement structure is described in detail. The following description is given of the structure to engage the contacts 5A having the shorter effective fitting length among the contacts 5A and 5B. The contacts 5A are press-fitted into the respective slots 31 from the front side (the one side in the press-fit direction). Each contact 5A is inserted between the upper and lower walls 33 and 32 of the housing 3 so that the back part of the fixed arm 51 of the contact 5A (a portion of the fixed arm on the insertion side of the joint spring portion in the insertion/removal direction) is press-fitted between the lower wall 32 and a joint wall portion (an upper regulation portion) 36, which is provided in the back part of the corresponding slot 31 and connects the adjacent partition walls 35. In such a manner, in this embodiment, the press-fitting range is limited to between the lower wall 32 and the joint portion 36. This facilitates press-fitting each contact 5A into the housing 3. Moreover, in this embodiment, the joint wall portion 36 is provided for the back part of the slot 31 (a portion of the slot 31 on the insertion side in the insertion/removal direction of the contact 5A which is inserted into the same slot 31). Accordingly, in the process of press-fitting the contact 5A into the slot 31, the contact 5A is inserted to a certain degree of the slot 31 before being press-fitted between the lower wall 32 and the joint portion 36. This can reduce deformation and damage of the contact 5A during the process of press-fitting the contact 5A into the slot 31.

Herein, in the process of inserting each contact 5 into the housing 3, the side of the inserted contact 5 which is first inserted into the slot 31 of the housing 3 is referred to as the insertion side of the contact 5 in the insertion/removal direction. In other words, the back part (the right part in FIG. 9) of the contact 5A which is inserted from the front side of the housing 3 is referred to as the insertion side of the contact 5 in the insertion/removal direction, and the front part (the left part in FIG. 9) thereof is referred to as a removal side in the insertion/removal direction. On the other hand, the front part (the left part in FIG. 4) of each contact 5B inserted from the back side of the housing 3 is referred to as the insertion side in the insertion/removal direction, and the back part (the right part in FIG. 4) thereof is referred to as a removal side in the insertion/removal direction.

In the example of the contacts 5B shown in this embodiment, each contact 5B is press-fitted so as to be sandwiched by the upper wall 33 and lower wall 32 of the housing 3. However, the press-fitting range of the contact 5B can be configured to be limited to between the lower wall 32 and a joint wall portion (an upper regulation portion) that is formed in a slot into which the contact 5B is inserted.

Figure 7:
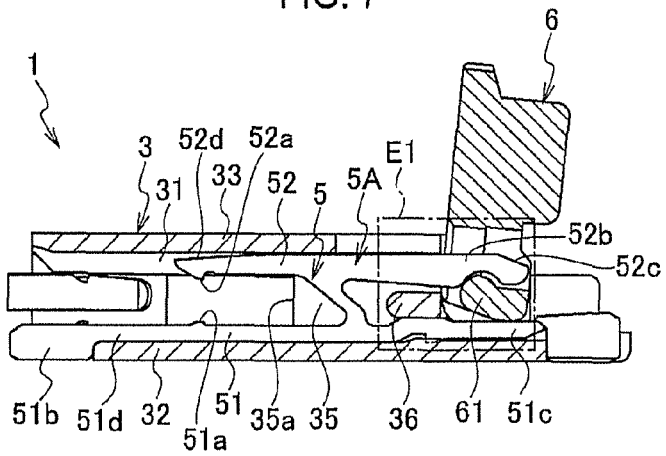
FIG. 7 is a cross-sectional view schematically illustrating a connector according to a comparative example.
Figure 8:
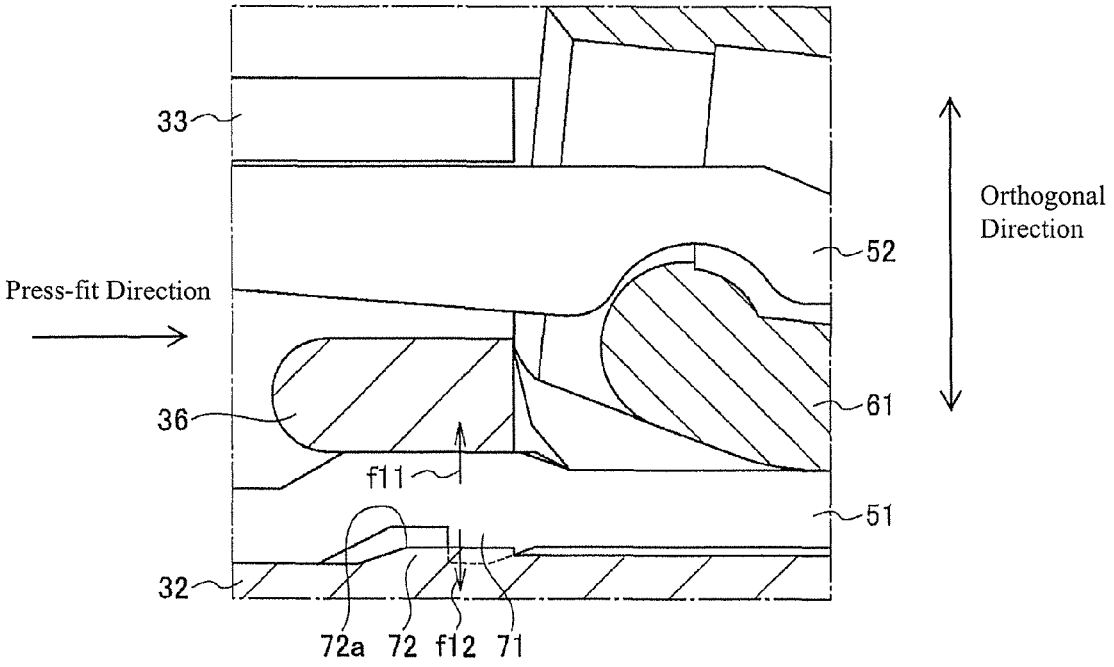
FIG. 8 is an enlarged view of an area E1 of FIG. 7.

FIG. 7 is a cross-sectional view schematically illustrating a connector 1 according to a comparative example. FIG. 8 is an enlarged view of an area E1 of FIG. 7. This structure involves such a problem in press-fitting the contacts 5A into the housing 3 as, when the contacts 5A are press-fitted into the housing 3, the housing 3 is subjected to a large load because of this press-fit force. Specifically, as illustrated in FIG. 8, a protrusion (a contact-side engagement portion) 71 protruding downward is provided in the back side (a portion of the fixed arm on the insertion side in the insertion/removal direction with respect to the joint spring portion) of the fixed arm 51 of each contact 5A. The lower wall 32 of the housing 3 is provided with an engagement portion (a housing-side engagement portion) 72 configured to be engaged with the protrusion 71. When the contact 5A is press-fitted into the housing 3 from the front side in FIG. 8 (from left to right), the protrusion 71 formed in the fixed arm 51 is engaged with the engagement portion 72 formed on the lower wall 32, so that the contact 5A is engaged with the housing 3.

In this process, upward press-fit force f11 (toward one side in the direction orthogonal to the press-fit direction) is produced around the center of an upper surface 72*a* of the engagement portion 72 in the front-back direction (the center thereof in the press-fit direction), and downward press-fit force f12 (toward the other side in the direction orthogonal to the press-fit direction) is produced at the protrusion 71. As illustrated in FIG. 8, the press-fit forces f11 and f12 are produced on a same vertical line in the vertical direction (in the orthogonal direction). Accordingly, the fixed arm 51 is subjected to outward pressure in the vertical direction and, therefore, applies a large load onto the lower wall 32 of the housing 3. This can create bulges due to press-fitting of the contacts in the back surface of the lower wall 32 of the housing 3.

Figure 9:
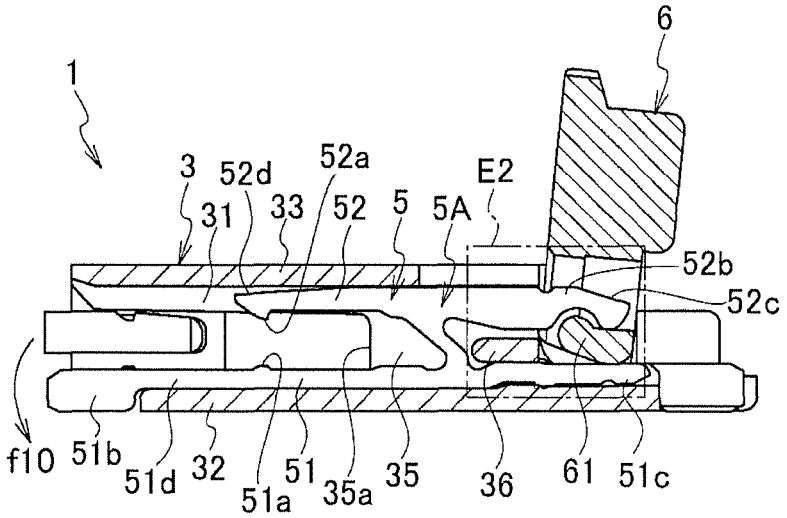
FIG. 9 is a cross-sectional view schematically illustrating the connector according to the embodiment of the present invention.
Figure 10:
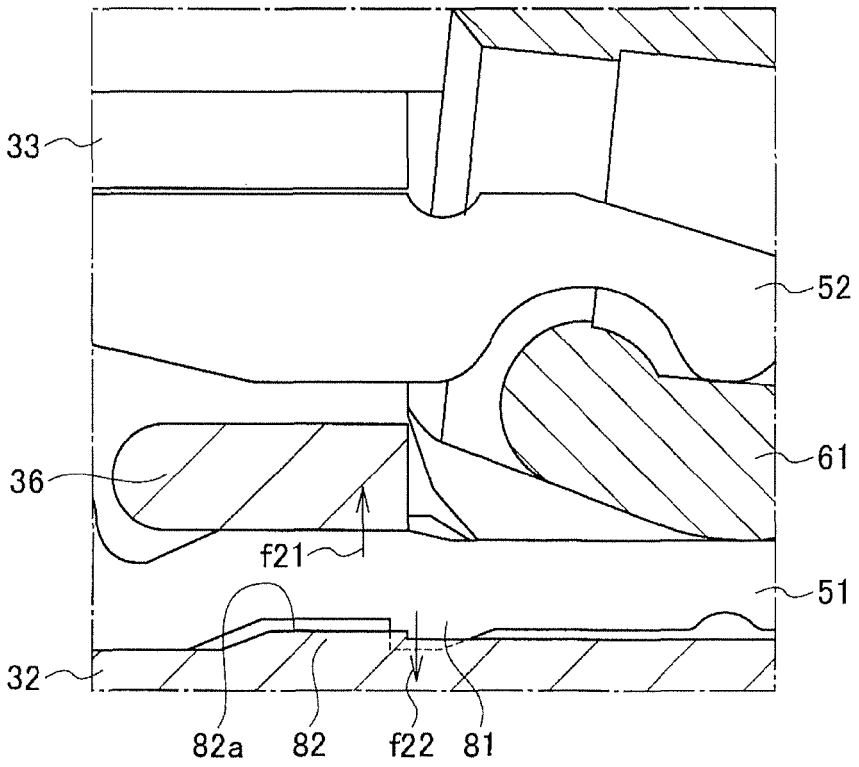
FIG. 10 is an enlarged view of an area E2 of FIG. 9.

FIG. 9 is a cross-sectional view schematically illustrating the connector 1 according to the embodiment of the present invention. FIG. 10 is an enlarged view of an area E2 of FIG. 9. Similarly to the comparative example, a protrusion (a contact-side engagement portion) 81 protruding downward is provided in the back side (a portion of the fixed arm on the insertion side in the insertion/removal direction with respect to the joint spring portion) of the fixed arm 51 of each contact 5A. Moreover, the lower wall 32 of the housing 3 is provided with an engagement portion (a housing-side engagement portion) 82 configured to be engaged with the protrusion 81. The connector 1 of this embodiment differs from the comparative example in that the protrusion 81 is placed to the right of that of the comparative example (protrusion 71) in FIG. 10. Specifically, in the comparative example, the protrusion 71 is engaged near the center of the upper surface 72*a* of the engagement portion 72 in the press-fit direction as illustrated in FIG. 8. On the other hand, in this embodiment, the protrusion 81 is engaged to the right of the center of the upper surface 82*a* of the engagement portion 82 in the press-fit direction as illustrated in FIG. 10 (the position shifted from the center thereof in the press-fit direction toward the one side in the press-fit direction).

The downward press-fit force f22 is, therefore, shifted to the right compared with the comparative example (press-fit force f12). On the other hand, the upward press-fit force f21 is produced near the center of the upper surface 82*a* of the engagement portion 82 in the press-fit direction in a similar manner to the comparative example (press-fit force f11). Accordingly, the contact 5A is engaged with the housing 3 at such a position that the press-fit forces f21 and f22 are not in a same vertical line. This can reduce a vertical pressure and, therefore, reduce the load on the housing 3.

Moreover, when the positions of the press-fit forces f21 and f22 are not aligned, rotation moment f10 counterclockwise in FIG. 9 works. The rotational moment f10 prevents the soldered portions (contacts 5) from floating, thus stabilizing the assembly dimensions.

When the back side of the fixed arm 51 provided with the protrusion 81 is press-fitted in the housing 3, the protrusion 81 is engaged with the engagement portion 82 so that the upper portion to the right of the center of the upper surface 82*a* of the engagement portion 82 in the press-fit direction is pressed downward and leftward. By this engagement between the protrusion 81 and engagement portion 82, the contact 5A is fixed to the housing 3 and is prevented from falling from the housing 3. In other words, when the protrusion 81 is press-fitted in a hooking manner from the insertion side in the insertion/removal direction of the contact 5A with respect to the engagement portion 82, the movement of the contact 5A relative to the housing 3 toward the removal side in the insertion/removal direction is limited.

Herein, it is assumed that each contact 5A is press-fitted into the housing 3 from left to right in the drawing and the protrusion 81 is located to the right of the engagement portion 82. In the structure of the example shown in the drawing, therefore, the protrusion 81 is engaged with the engagement portion 82 on the right side of the center of the upper surface of the engagement portion 82. However, the present invention is not limited to this structure. For example, when the protrusion 81 is located to the left of the engagement portion 82, the protrusion 81 is engaged with the engagement portion 82 on the left side of the center of the upper surface of the engagement portion 82.

In the above description, the press-fit forces f21 and f22 are produced in the vertical direction of the housing 3. However, the directions of the press-fit forces f21 and f22 are not limited to the above direction. The press-fit forces only need to be produced in the direction orthogonal to the press-fit direction, and the orthogonal direction may be any direction.

In the example described above, when the contacts 5A having the shorter effective fitting length among the contacts 5 are press-fitted into the housing 3, each contact 5A is engaged with the housing 3 at such a position that press-fit forces produced in the direction orthogonal to the press-fit direction are not in the same straight line. However, the contacts 5B having the longer effective fitting length can be also configured so that the press-fit forces produced in the direction orthogonal to the press-fit direction are not in the same straight line.

In a connector using plural types of contacts, the present invention only needs to be applied to at least one type of contacts.

Moreover, the contacts need to include at least one first contact which is engaged with the housing at such a position that the press-fit forces produced in the directions orthogonal to the press-fit direction are not in a same straight line when the contacts are press-fitted into the housing. The connector including plural contacts 5A, for example, can be configured so that some of the plural contacts 5A are engaged with the housing at such a position that the press-fit forces produced in the directions orthogonal to the press-fit direction are not in a same straight line when the contact is press-fitted into the housing.

As described above, according to the connector 1 of the embodiment, the contacts 5 (contacts 5A) are engaged with the housing 3 in a position where the press-fit forces produced in the direction orthogonal to the press-fit direction are not in the same straight line when the contacts 5 are press-fitted into the housing 3. In other words, the contacts 5 include at least one contact (first contact) 5A which is engaged with the housing 3 at such a position that the press-fit forces produced in the directions orthogonal to the press-fit direction are not in a same straight line when the contact 5 is press-fitted into the housing 3. This structure can reduce an outward pressure and reduce the load on the housing 3.

Specifically, the direction orthogonal to the press-fit direction is a direction for the contact 5 (contact 5A) to press the flat cable 2. The contacts 5 can be engaged with the housing 3 at such positions where the press-fit forces f21 and f22 produced in the direction for the contacts 5 to press the flat cable 2 are not in the same straight line.

Moreover, each contact 5 (contact 5A) is provided with the protrusion 81 protruding in the direction orthogonal to the press-fit direction, and the housing 3 is provided with the engagement portion 82 configured to be engaged with the protrusion 81. The protrusion 81 is engaged on the right side of the center of the upper surface 82*a* of the engagement portion (the position shifted from the center thereof in the press-fit direction toward one side in the press-fit direction). The contact engagement structure can be, therefore, implemented with a simple structure in which the contacts are engaged by engagement of the protrusion 81.

The preferred embodiment of the present invention is described above, but the present invention is not limited to the embodiment and can be variously changed. For example, in the embodiment, the structure is described in which the contacts 5 are engaged through the protrusions 81. However, the present invention is not particularly limited to this and can employ various types of contact engagement structures.

Figure 11:
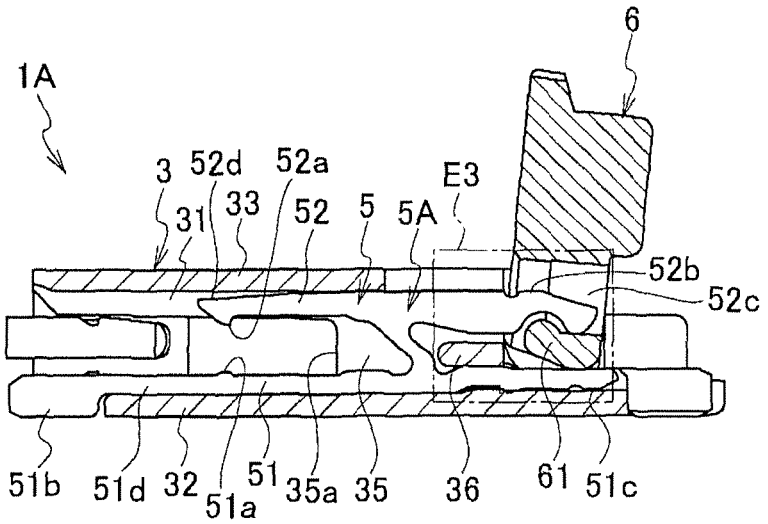
FIG. 11 is a cross-sectional view schematically illustrating a first modification of the connector.
Figure 12:
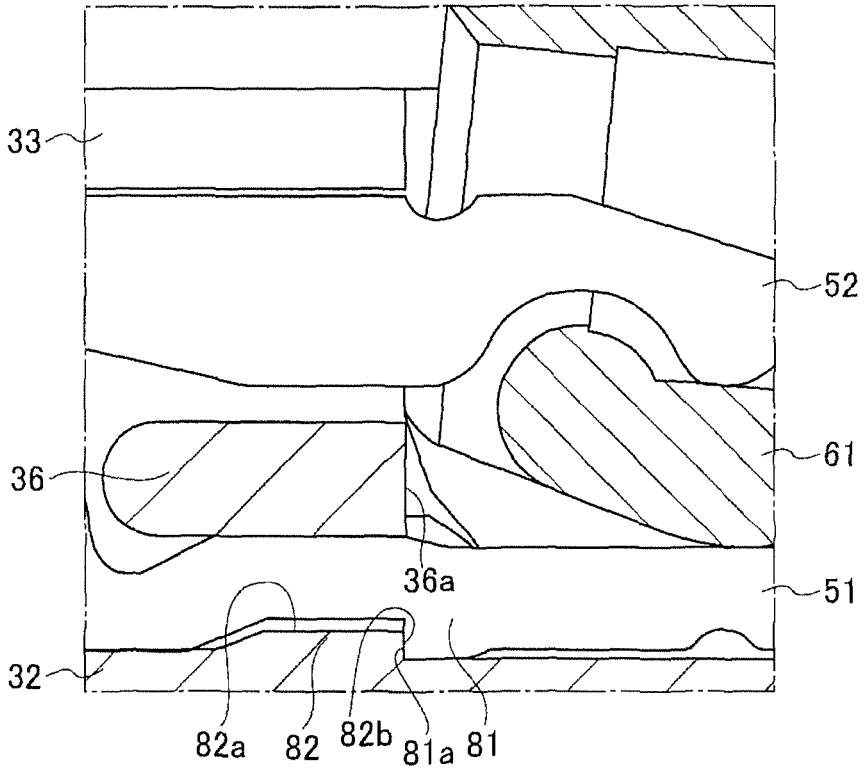
FIG. 12 is an enlarged view of a region E3 in FIG. 11.

For example, the connector can include a connector 1A illustrated in FIGS. 11 and 12.

Figure 13:
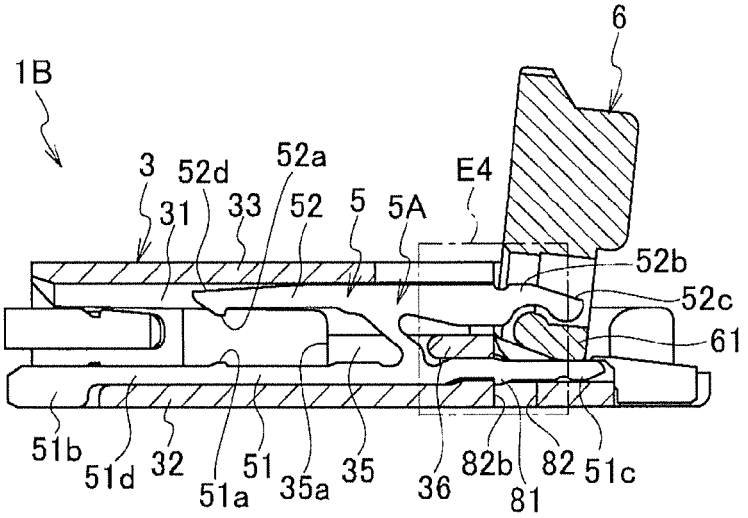
FIG. 13 is a cross-sectional view schematically illustrating a second modification of the connector.

FIG. 11 is a cross-sectional view schematically illustrating the connector 1A according to a first modification of the connector 1, and FIG. 13 is an enlarged view of a region E3 in FIG. 11.

The connector 1A basically has a substantially same configuration as that of the connector 1 shown in the embodiment. Specifically, the connector 1A includes: a housing 3 accommodating conductive contacts 5, an insertion opening 4, and a lever 6. The insertion opening 4 is provided in the front side of the housing 3 and is defined by the upper and lower walls 33 and 32 of the housing 3 at the top and bottom. The flat cable 2 can be inserted into the insertion opening 4. The lever 6 is provided in back part of the housing 3. The lever 6 is turned to bring the contacts 5 into pressure contact with the flat cable 2 and establish electrical continuity therebetween.

The top and bottom of the insertion opening 4 are defined by the upper and lower walls 33 and 32 of the housing 3, and the both ends thereof in the width direction are defined by the side walls 34 of the housing 3. Also in the modification, the both ends of the insertion opening 4 in the width direction may be defined by side walls made of a material different from the housing 3 (for example, metallic plates, resin plates, or the like).

Each contact 5 includes a bar-shaped fixed arm 51 and a bar-shaped moving arm (a moving arm driven by a cam portion 61 provided for the lever 6) 52. The fixed arm 51 extends in the front-back direction. The moving arm 52 extends in the same direction as the fixed arm 51 extends and faces the fixed arm 51 in the thickness direction of the flat cable 2. The fixed and moving arms 51 and 52 have longitudinally intermediate portions joined with a joint spring portion 53 to form a substantially H shape as a whole. Similarly in this modification, each of the contacts 5 is accommodated in the housing 3 so that the fixed arm 51 is located below the moving arm 52.

The contacts 5 include the contacts (first contacts: contacts having short effective fitting length) 5A and the contacts (second contacts: contacts having long effective fitting length) 5B. In this modification, the number of types of the contacts 5 is not limited to two and may be one, three, or more.

The contacts 5A are inserted into the respective slots 31 from the front side, and the contacts 5B are inserted into the respective slots 31 from the back side.

An engagement portion (a housing-side engagement portion) 82 protruding upward is provided in upper part of the lower wall 31 of the housing 3, and a protrusion (a contact-side engagement portion) 81 protruding downward is provided in the bottom of the back part (a portion of the fixed arm on the insertion side in the insertion/removal direction with respect to the joint spring portion) of the fixed arm 51 of the contact 5A. The protrusion 81 is engaged with the engagement portion 82 provided in the lower wall 32 to engage the contact 5A with the housing 3. The engagement portion (housing-side engagement portion) 82 is provided on the insertion side in the insertion/removal direction with respect to the center in the insertion/removal direction, of the lower wall 32 of the housing 3.

As described above, the contacts 5 of the connector 1A include contacts (first contacts) 5A each provided with the protrusion (the contact-side engagement portion) 81 which is engaged with the engagement portion (the housing-side engagement portion) 82 that is provided in the lower wall 31 of the housing 3 and protrudes upward. The contacts need to include at least one first contact provided with the contact-side engagement portion which is engaged with the housing-side engagement portion formed in the housing when the first contact is inserted into the housing 3 independently of the number of types of the contacts (even if the number of types of contacts is one, two, or more).

The movement of the contact (first contact) 5A relative to the housing 3 toward the removal side in the insertion/removal direction (movement of the contact 5A relative to the housing 3 toward the front) is limited when the protrusion (contact-side engagement portion) 81 is engaged with the engagement portion (housing-side engagement portion) 82.

To be specific, as illustrated in FIG. 12, a front face (a face on the removal side in the insertion/removal direction) 81*a* of the protrusion (the contact-side engagement portion) 81 comes into contact with a back face (a face on the insertion side in the insertion/removal direction) 82*b* of the engagement portion (the housing-side engagement portion) 82 to limit the movement of the contact (the first contact) 5 relative to the housing 3 toward the removal side in the insertion/removal direction (movement of the contact 5A relative to the housing 3 toward the front). The back face (the face on the insertion side in the insertion/removal direction) 82*b* of the engagement portion (the housing-side engagement portion) 82 is in surface contact with the front face (the face on the removal side in the insertion/removal direction) 81*a* of the protrusion (the contact-side engagement portion) 81 in this modification but does not need be in surface contact with the same.

Also in this modification, a joint wall portion (upper regulation portion) 36 joining the adjacent partition walls 35 is provided in back part of the slot 31 in which each contact (first contact) 5A is inserted. The joint wall portion (upper regulation portion) 36 prevents back part of the fixed arm 51 (a portion of the fixed arm on the insertion side in the insertion/removal direction with respect to the joint spring portion) from rising. In other words, the housing 3 includes the joint wall portion (the upper regulation portion) 36 which limits the rising of the insertion part of the fixed arm 51 in the insertion/removal direction. The back face (the face on the insertion side in the insertion/removal direction) 82*b* of the engagement portion (the housing-side engagement portion) 82 and a back face (a face on the insertion side in the insertion/removal direction) 36*a* of the joint wall portion (the upper regulation portion) 36 are provided so as to exist in a same plane. The housing 3 can be therefore formed without using a complicated mold.

Herein, in this modification, the contacts (the first contacts) 5A are inserted into the housing 3, instead of being press-fitted, with the protrusion (the contact-side engagement portion) 81 being engaged with the engagement portion (the housing-side engagement portion) 82. Even in the structure of the modification, in the process of inserting each contact (first contact) 5A into the housing 3, the contact (the first contact) 5A is press-fitted in the housing 3 when the protrusion (the contact-side engagement portion) 81 is located between the lower wall 32 and joint wall portion 36. However, the housing 3 is not subjected to press-fit forces when the protrusion (the contact-side engagement portion) 81 is engaged with the engagement portion (the housing-side engagement portion) 82.

In this modification, the movement of each contact (the first contact) 5A relative to the housing 3 toward the insertion side in the insertion/removal direction (movement of the contact 5A relative to the housing 3 toward the back) is limited by the terminal portion 51*b*. The downward movement of the contact (the first contact) 5A relative to the housing 3 is limited by the lower wall 31.

As described above, in this modification, each contact 5A is inserted into the housing 3 while the contact 5A is prevented from moving relative to the housing 3 toward both sides in the insertion/removal direction and both sides in the vertical direction. Accordingly, the contacts 5A can be prevented from moving even if no press-fit forces are produced in the housing 3.

In the example of the modification, each contact 5B is also press-fitted so as to be sandwiched by the upper and lower walls 33 and 32 of the housing 3 of the contact 5B. However, it is possible to apply the structure of the modification to the contacts 5B.

The above-described modification can provide the same operations and effects as those of the aforementioned embodiment.

Moreover, in this modification, each contact (first contact) 5A is inserted into the housing 3 instead of being press-fitted when the protrusion (the contact-side engagement portion) 81 is engaged with the engagement portion (housing-side engagement portion) 82. This can minimize the force applied to the housing 3 by the contacts 5A, thus further reducing the load on the housing 3.

The aforementioned structure is particularly effective in the case where the contact-side engagement portion 81 is provided in a portion of the fixed arm on the insertion side in the insertion/removal direction with respect to the joint spring portion and the case where the housing-side engagement portion 82 is provided on the insertion side in the insertion/removal direction with respect to the center in the insertion/removal direction, of the lower wall 32 of the housing 3. This is because the engagement between the housing-side engagement portion 82 and contact-side engagement portion 81 is comparatively deformable in the housing 3.

Moreover, in the modification, the front face (the face on the removal side in the insertion/removal direction) 81*a* of the protrusion (the contact-side engagement portion) 81 comes into contact with the back face (the face on the insertion side in the insertion/removal direction) 82*b* of the engagement portion (housing-side engagement portion) 82 to limit the movement of the contact (first contact) 5 relative to the housing 3 toward the removal side in the insertion/removal direction (movement of the contact 5A relative to the housing 3 toward the front). Accordingly, the movement of each contact (first contact) 5A relative to the housing 3 toward the removal side in the insertion/removal direction (movement of the contact 5A relative to the housing 3 toward the front) can be limited with a simpler structure.

Furthermore, in the modification, the housing 3 includes the joint wall portion (upper regulation portion) 36 which limits rising movement of the insertion side of the fixed arm 51 in the insertion/removal direction. The insertion side of the fixed arm 51 in the insertion/removal direction is prevented from rising by the joint wall portion (upper regulation portion) 36. Accordingly, each contact 5A can be prevented from rotating in such a direction that the terminal portion 51*b* moves down. It is therefore possible to prevent the connector 1A from being inclined to the circuit substrate C.

Obviously, various other changes can be made without departing from the scope of the present invention.

Figure 14:
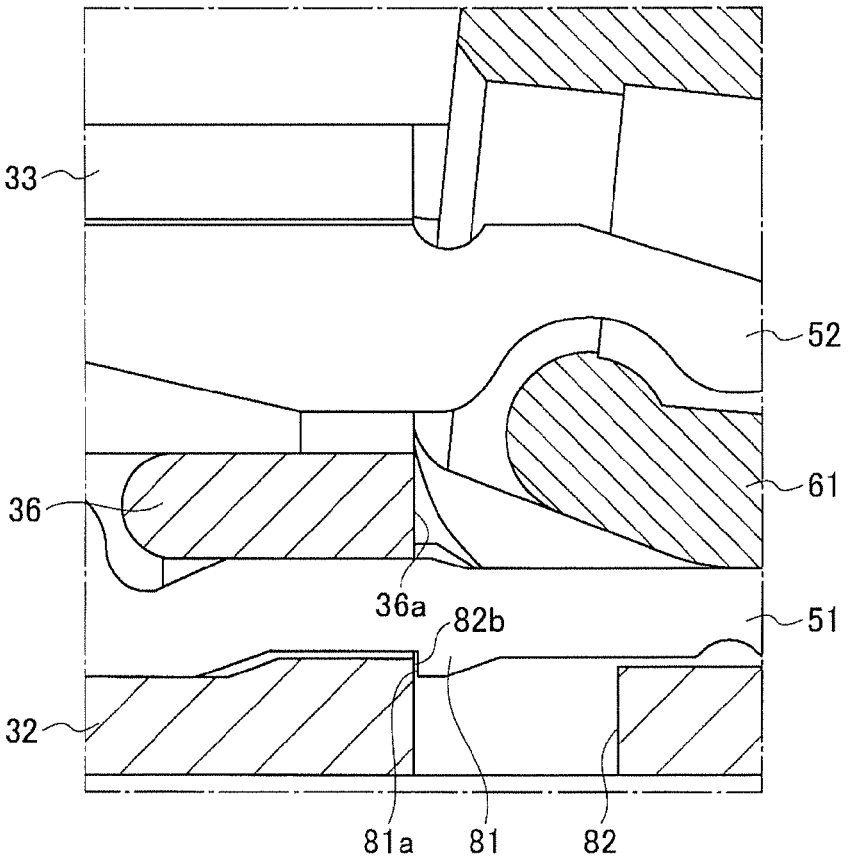
FIG. 14 is an enlarged view of a region E4 in FIG. 13.

The contact-side engagement portion can have various shapes, such as a step-like shape, for example. The housing-side engagement portion can also have various shapes, such as a step-like shape, a concave, or a through-hole. As illustrated in FIGS. 13 and 14, if the housing-side engagement portion is a through-hole 82, in particular, the engagement strength can be increased, and the engaged state can be easily confirmed.

The housing-side engagement portion can be formed not only in the lower wall but also in the joint wall portion (upper regulation portion), another portion of the housing, or the like. Moreover, the place where the contact-side engagement portion is provided is not limited to the lower part of the fixed arm and can be another portion of the first contact.

What is claimed is:

1. A connector, comprising:

a housing accommodating a conductive contact;

an insertion opening to which a flat cable can be inserted, the insertion opening being provided in a front part of the housing and being defined by upper and lower walls of the housing at a top and bottom; and a lever which is provided in a back part of the housing and is turned to bring the contact into pressure contact with the flat cable and establish electrical continuity therebetween, wherein, the contact includes a first contact which is engaged with the housing at such a position that press-fit forces produced between a lower surface of the upper wall and an upper surface of the lower wall which define the insertion opening and produced in an orthogonal direction orthogonal to a press-fit direction in which the contact is inserted into the housing when the contact is press-fitted into the housing are not in a same straight line, the first contact includes a terminal portion mounted on a circuit substrate located under the housing, a first protrusion protruding downward and producing a press-fit force downward when the first contact is press-fitted into the housing and a second protrusion protruding upward and producing a press-fit force upward when the first contact is press-fitted into the housing, and the first protrusion is formed at a position shifted from the second protrusion in the press-fit direction, and the second protrusion is located at a terminal portion side with respect to the first protrusion.

2. The connector according to claim 1, wherein the orthogonal direction is a direction that the first contact comes into pressure contact with the flat cable.

3. The connector according to claim 2, wherein the orthogonal direction is a vertical direction, the housing includes an engagement portion engaged with the protrusion, and the first protrusion is engaged with the engagement portion at a position shifted in the press-fit direction from the center of an upper surface of the engagement portion in the press-fit direction.

4. A connector, comprising:

a housing accommodating a conductive contact;

an insertion opening to which a flat cable can be inserted, the insertion opening being provided in a front part of the housing and being defined by upper and lower walls of the housing at a top and bottom; and a lever which is provided in a back part of the housing and is turned to bring the contacts into pressure contact with the flat cable and establish electrical continuity therebetween, wherein, the contact includes a first contact provided with a contact-side engagement portion which is engaged with a housing-side engagement portion provided in the housing when the first contact is inserted into the housing, and when the contact-side engagement portion is engaged with the housing-side engagement portion, movement of the first contact relative to the housing toward only a removal side of an insertion side and the removal side in an insertion/removal direction is limited by the engagement of the contact-side engagement portion with the housing-side engagement portion, wherein movement of the first contact relative to the housing toward the removal side in the insertion/removal direction is limited by bringing a face of the contact-side engagement portion on the removal side in the insertion/removal direction into contact with a face of the housing-side engagement portion on the insertion side in the insertion/removal direction, and the first contact is composed of a moving arm driven by a cam portion provided for the lever and a fixed arm fixed to the housing, the moving and fixed arms being joined with a joint spring portion to form a substantially H shape, and the fixed arm is located below the moving arm while the contact-side engagement portion is provided in the fixed arm, and the housing-side engagement portion is provided in the lower wall of the housing.

5. The connector according to claim 4, wherein a step portion including the face of the housing-side engagement portion on the insertion side in the insertion/removal direction is formed at the lower wall of the housing.

6. The connector according to claim 4, wherein the contact-side engagement portion is provided in a portion of the fixed arm on the insertion side in the insertion/removal direction with respect to the joint spring portion.

7. The connector according to claim 6, wherein the housing includes an upper regulation portion which limits upward movement of the insertion side of the fixed arm in the insertion/removal direction.

8. The connector according to claim 4, wherein the contact-side engagement portion is provided in lower part of the fixed arm, and the housing-side engagement portion is provided in upper part of the lower wall of the housing.

9. The connector according to claim 8, wherein the housing-side engagement portion is provided on the insertion side in the insertion/removal direction with respect to a center in the insertion/removal direction, of the lower wall of the housing.

* * * * *